United States Patent [19]

Theuerkauff

[11] 4,126,173

[45] Nov. 21, 1978

[54] SHUTTER ARRANGEMENT

[76] Inventor: Ernst Theuerkauff, Mergenthalerstrasse 8, 3014 Laatzen 1, Germany

[21] Appl. No.: 862,757

[22] Filed: Dec. 20, 1977

[30] Foreign Application Priority Data

Feb. 2, 1977 [DE] Fed. Rep. of Germany ..... 2704346

[51] Int. Cl.[2] ..... E06B 9/24

[52] U.S. Cl. ..... 160/229 R; 160/196 D; 160/231 R; 160/236

[58] Field of Search ..... 160/32, 33, 196, 201, 160/229, 231 R, 232, 235, 236

[56] References Cited

U.S. PATENT DOCUMENTS

| | | | |
|---|---|---|---|
| 1,427,915 | 9/1922 | Sellgren | 160/201 |
| 2,068,977 | 1/1937 | Dodge | 160/236 |
| 2,252,737 | 8/1941 | Siess | 160/201 |
| 2,766,822 | 10/1956 | Potter | 160/33 |
| 2,893,483 | 7/1959 | Holdeman et al. | 160/229 R |
| 3,489,200 | 1/1970 | Recchiome | 160/235 |

*Primary Examiner*—Peter M. Caun

*Attorney, Agent, or Firm*—Haseltine, Lake & Waters

[57] ABSTRACT

A shutter arrangement with profiled plastic strips which have, on their adjacent sides, interlocking complementary elements with adjacent profile strips that are mounted pivotably relative to one another on armored chain links. The profile strips are made of a transparent plastics and have, on their narrow side, at least one projection which is inserted and fastened in a complementary opening of a link of the associated armored chain. The profile strips may be made of acrylic glass or polycarbonate. All surfaces of the profile strips may be polished, and the projection of the profile strips may be substantially trapezoidal. The projections of the profile strips may be fastened in an opening of the chain links by a cross bolt. At the same time, the chain links may be made of substantially light metal, with a guide projection located on both sides of at least part of the chain links. The guide projection on both sides may be in the form of a spacer pin, projecting on both sides, and held in a cross bore of the chain links.

13 Claims, 5 Drawing Figures

SHUTTER ARRANGEMENT

BACKGROUND OF THE INVENTION

The present invention relates to a shutter with profiled strips made of plastic and which have on their adjacent sides an interlocking complementary design, with adjacent profiled strips that are pivotable relative to one another.

It is already known in the art how to produce shutters with profiled strips of wood, sheet steel, light metal or — for several past years — from certain synthetics (e.g., hard PVC). The profiled strips are connected to one another by straps, galvanized steel platelets, etc., in such a way that they can be rolled up on a roller in the shutter box. If, with the shutters lowered, a view from the closed opening is to be possible, light slots are placed in the shutters to ensure the desired view and passage of light.

The use of shutters made of certain synthetics which has become more pronounced during recent years, made possible an appreciable reduction of the weight of the shutters. Whereas, frequently, the purpose of darkening the opening to be shuttered was in the foreground, the problem of being burglar proof could not be solved satisfactorily because of the plastic profiles used, and the properties of the plastics selected.

There are also known shutters made of a slightly transparent material and which are not used for darkening but rather shading the light entering through the closed opening. However, there resulted difficulties with these since the profile projections fastening the strips to one another became unpleasantly manifest during light passage and the profiled strips, fastened along their width, because of the weight to be carried by each profiled strip of the strips underneath, experienced light bending which with transparent synthetics lead to undersirable visible tension in the overall shutter area.

It is, therefore, an object of the present invention to provide a shutter of the above type further in such a way that, avoiding the disadvantages shown, a full view is ensured with good functional reliability and good protective effect.

Another object of the present invention is to provide a shutter arrangement of the foregoing character which is substantially simple in construction and may be economically fabricated.

A further object of the present invention is to provide a shutter arrangement, as described, which may be readily maintained in service and which has a substantially long operating life.

SUMMARY OF THE INVENTION

The objects of the present invention are achieved by providing that the profiled strips of the shutters are made of a transparent plastic and are provided on their narrow sides with at least one profile projection which is inserted into a complementary opening of a link of an armored chain and is fastened there. Material for the profiled strips is preferably acryl glass, e.g., polymethacrylester (with or without polyacrylonitrile), polycarbonate or other suitable transparent synthetics.

The shutter in accordance with the present invention permits, unlike known shutters, the possibility of a free view through the clear (or tinted) synthetic disks, with the design of the shutter ensuring that only an insignificant reduction of the view is produced by the edges of the profiled strips. Preferably, all surfaces of the profiled stips are completely polished, further ameliorating possible slight deterioration of the optical picture. Simultaneously, the shutter design in accordance with the present invention provides a desirable decorative effect along the edges of the profiled strips. The shutter in accordance with the present invention avoids an optical separation of the space closed by the shutter, simultaneously ensuring good burglar protection because of the high breaking strength of the inserted transparent material. This is important, e.g., with display cabinets, exhibit rooms, etc. which are only partly occupied by personnel but for advertising reasons must always be accessible to observation by the public. The shutter in accordance with the present invention permits a quick and easy opening of rooms separated in such manner, without the necessity of providing large transparent glass doors with the required swing-open angle.

The methods in accordance with the invention ensure that the profiled strips are not fastened to one another beyond their width side, completely avoiding the occurrence of impairments resulting from such fastening devices. Due to the methods of the present invention, the strips are merely guided over the lateral armored chains, ensuring a constant spacing of successive profiled strips through the pivotably fastened armored chain links and the profiled strips fastened in them. The profiled strips are not further connected to one another beyond their width side, so that a buildup of stress fields, impairing the view through the individual strips cannot be caused inside a profiled strip by adjacent profiled strips. This is accomplished by the joint action of the measures in accordance with the present invention, with the design of the projections of the profiled strips and the associate opening of the links of the armored chain providing a precise fixing of the position of the individual profiled strips relative to one another, which is important to avoid undesirable impairment of the optical viewing through the shutters.

A guidance projection is located to advantage on both sides of at least part of the chain links of one or two armored chains; the chain links themselves are advantageously made of light metal. A simple and yet effective guidance results if the guidance projections used has the form of a spacer pin protruding on both sides and located in a cross bore of the associate chain link; these spacer pins are advantageously made of a material with good sliding properties (e.g. Teflon). This results in good guidance in the guide rails to be used, ensuring a uniform alignment of the individual profiled strips in the closed position and hence a uniformly good viewing.

The shutter in accordance with the present invention cannot only be installed in the conventional form closing from the top downward or from the bottom upward, but can also be used so that it slides sideways for closing off a room, etc. In this case it is an advantage if the guidance projections are only formed on chain links of the one armored chain while the chain links of the other armored chain are provided with hooks. These hooks can be hooked to a special guide rail located at the room ceiling so that the profiled strips hang down vertically and experience a lateral guidance on their bottom end in a guide rail fastened below, e.g. on the floor.

The hooks are advantageously formed as a track roller arrangement which preferably has a carrier extending in the direction of the profiled strips; this carrier is fastened with one end to the associate chain link and has a track roller each on both sides of its other end.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
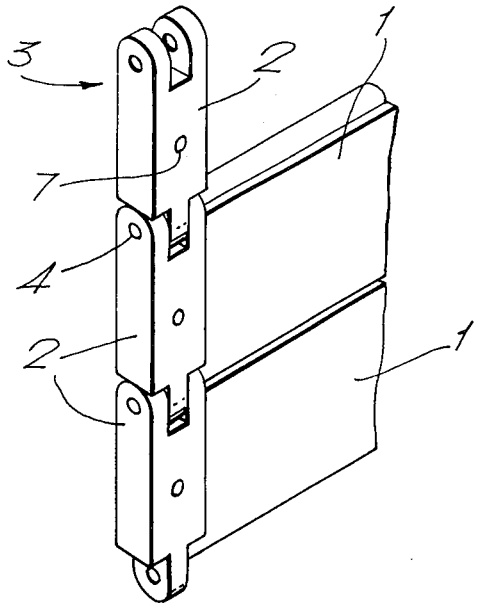
FIG. 1 shows the partial view of a lowered shutter in accordance with the present invention.

FIG. 1 shows a perspective view of part of a lowered shutter in accordance with the present invention.

Longitudinal profiled strips 1 made of a suitable fully transparent material such as acryl glass, polycarbonate, etc. are inserted on both sides with their narrow sides into an aluminum link 2. The connected aluminum links 2 form each on both sides of the profiled strips 1, an armored chain 3. The individual link of the armored chain 3 are pivotable relative to one another with pivot or swivel bolts 4, free of play and transmitting force. Depending on the dimensions of links 2 and swivel bolsts 4, the armored chains cannot only take tensile load, but also compressive load or shear forces, if lateral support is provided. For example, it is possible to roll out the shutter of the invention in the horizontal direction where, with proper dimensioning, the link chains themselves can form the carrying suspension or support for the profiled strips. With vertical arrangement of the shutter, the profiled strips 1 remain to a large extent free of forces, and independent of the length and the load to which the shutter itself is exposed. This avoids loads on the profiled strips 1 which otherwise might lead to the formation of unattractive and disturbing stress configurations.

Links 2 are made of aluminum since aluminum is an easily castable and sufficiently strong and light material. It is capable of absorbing or sustaining large forces but can be reworked inexpensively. If the requirements of a link 2 are met, it may also be made from another particularly suited material, such as die cast synthetic material or zinc.

Figure 2:
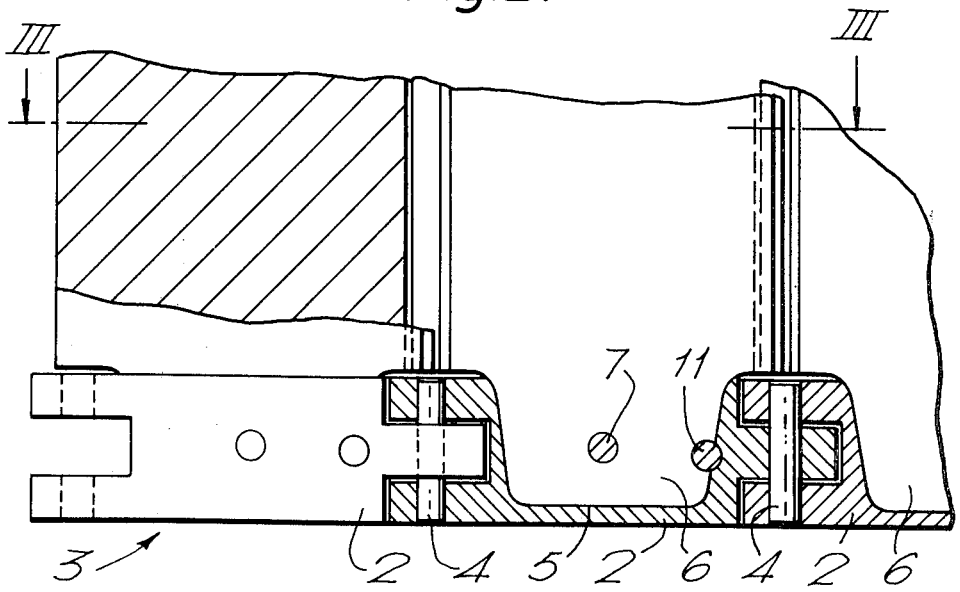
FIG. 2 shows a partially sectioned view of one of the lateral armored chains with inserted profiled strips.

The links 2 and the associate profile strips 1 are shown in FIG. 2 in their actual size in a side view. Each link 2 has on its rear side, a forklike recess and on its front side a projection fitting into the recess of the next link. The projection of the preceding link and the forklike recess of the succeeding link has a through-going bore to hold the swivel pin 4; the bore in such that the swivel pin 4 is press-fitted in one of the two links connected by it and can be rotated relative to the other link by a suitably dimensioned tolerance fit.

Thus, each of the links has at its front and rear side, a bore to hold a swivel pin 4. Between these two bores, an opening 5 is cast or machined into links 2 and a tongue 6 fitting opening 5 is formed on both sides of profiled strips 1. This tongue is prevented from sliding out by means of a locking pin 7 passing through each link 2. The tongue 6 of each profiled strip, as shown in FIG. 2 for the middle link, is trapezoidal, but it may also, as shown in FIG. 2 for the right-hand cut link, be semicircular.

Figure 3:
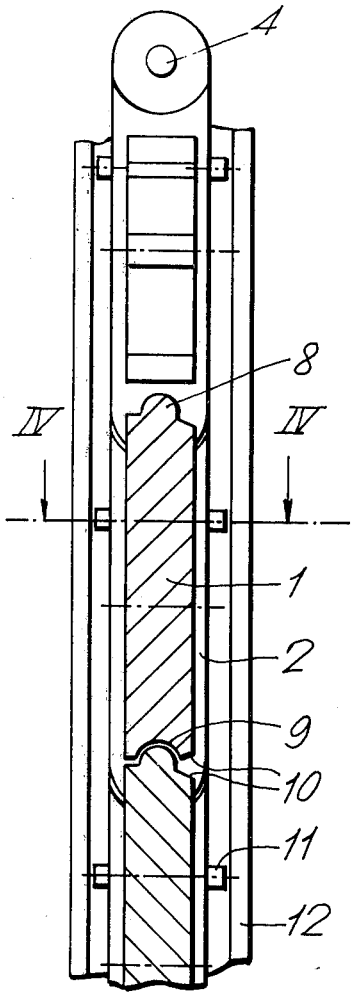
FIG. 3 shows a section taken along line III—III of FIG. 2.

Otherwise, the links 2, as shown in FIG. 3, have front and rear sides such that they can be pivoted relative to one another about the pivot pin 4 by an angle as desired.

As is also shown in FIG. 3, each profiled strip 1 has on one of its lengthwise sides, a strip 8 and on the facing lengthwise side, a fillet 9 fitting the strip; both represent a complementary design which provides for a tight pivotable contact of the individual profiled strips 1. Also, a stop 10 may be provided on the complementary arrangement 8, 9 on each of the profiled strips, or on the front and rear edge of one of the profiled strips; this stop permits the pivoting of two adjacent profiled strips for rolling up the shutter by a certain angle, but prevents the springy twisting of the profiled strips through violent action, when an attempt is made to break open the shutter in accordance with the present invention.

The shutter in accordance with the present invention may run with its armored chain in a hollow track 12 as guide (FIG. 3), with a spacer pin 11 located on each link 2 as a guide projection; this spacer pin seats in a cross bore of chain link 2 and protrudes on both sides (FIG. 3). Distance pin 11 and hollow track 12 together form a slide guide track for armored chain 3. To improve the sliding, at least one of these two parts may have a coat of PTFE or may be made itself of PTFE.

Figure 4:
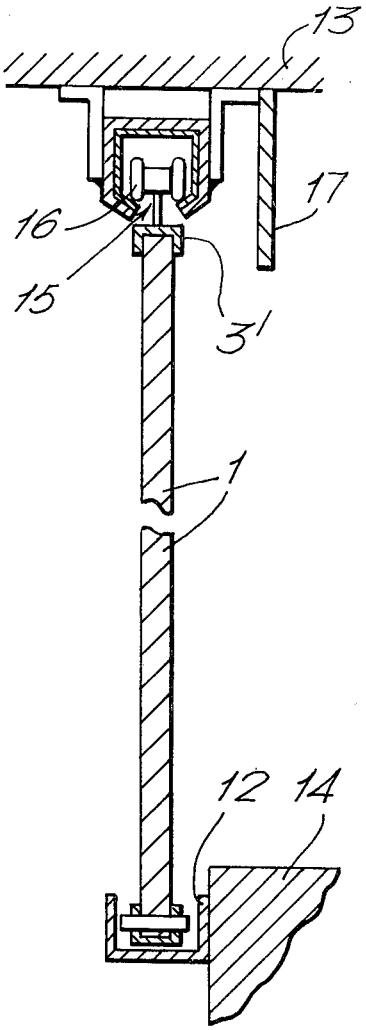
FIG. 4 shows a section taken along line IV—IV in FIG. 3.

As evidenced from FIG. 2, the spacer pin 11 is not located in the middle between the two pivot bolts 4 of a chain link 2, but closer to one end of link 2 as shown clearly in FIG. 2; thus a large guide lever arm distance from the center of rotation is achieved. The embodiment shown in FIGS. 1 to 3 can be used both in a horizontal and a vertical shutter. FIG. 4 shows a section taken along line IV—IV in FIG. 3 when using the armored chain shown there as lower guide for a horizontal shutter with hanging profiled strips 1. This shutter is located between ceiling 13 and sales desk 14 of a sales room.

The upper armored chain 3' has a track roller arrangement hence a component with at least one track roller whose axis is located on a rigid carrier which, in turn, is rigidly connected to a chain link 2. With the embodiment shown, the track roller arrangement 15 has two holding carriers (FIG. 5) which are located on a track carriage having two track 16 rollers on both sides. The track rollers 16 run in a U-profiled member with the U-base mounted on the ceiling 13. The legs therefore are bent inwards and have a coat on its inside, the track surface.

Track roller arrangement 15 and armored chain 3' are covered by a guard plate 17 and are protected against interference.

The hollow track 12 forming the track on the underside of the shutter is mounted on the side of a sales counter top 14 so that it serves as guard.

Figure 5:
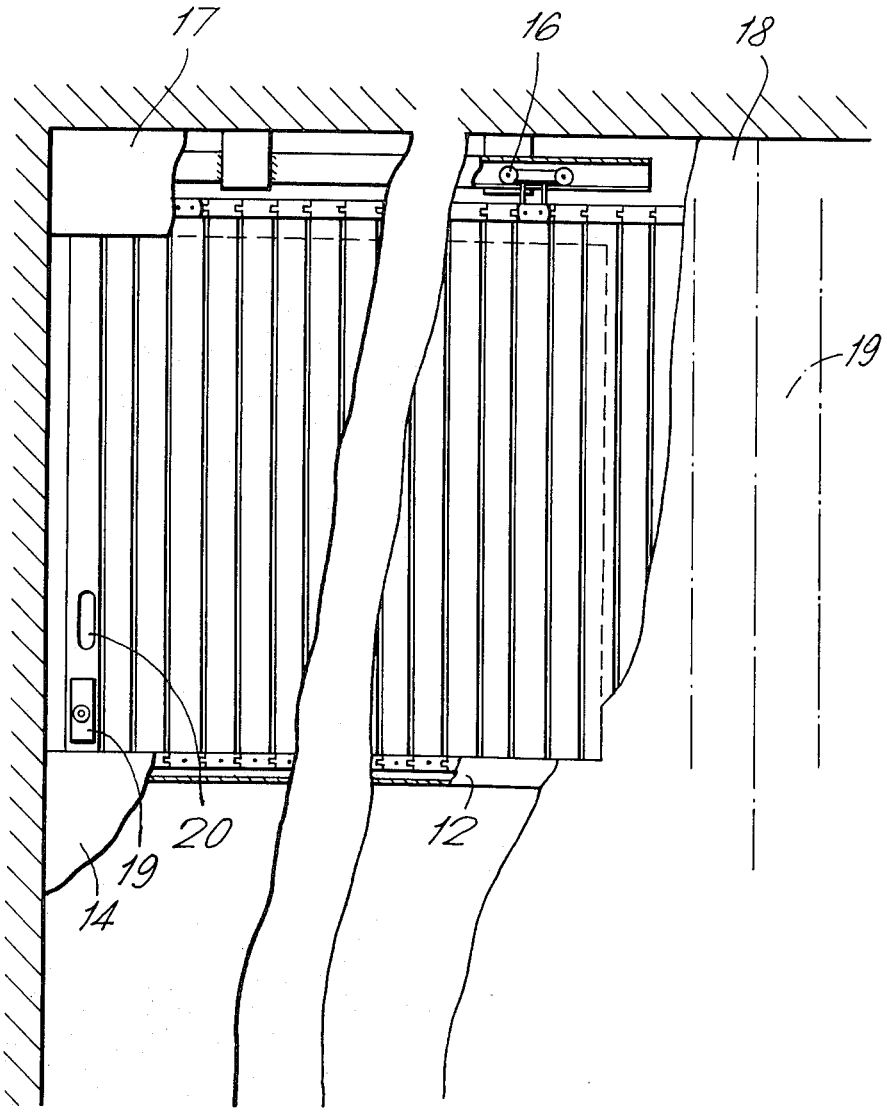
FIG. 5 shows a partially-sectioned front view of a sales desk having a shutter in accordance with the present invention.

FIG. 5 shows the shutter already shown as section in FIG. 4 in a sideview when installed; above and on the side of the counter top 14 is a roller cabinet 18 with a motor or spring driven roller 19. The shutter is unrolled from this roller 19 against the force of a spring (not shown) and lowered over the counter top 14 after which the shutter (FIG. 5, left-hand side) with a lock installed in the shutter, runs against a strike located on the wall.

For better handling of the shutter, a cutout usuable as handle is located above the lock.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptation should and are intended to be comprehended within the meaning and range of equivalents of the following claims.

I claim:

1. A shutter arrangement comprising: profiled plastic strips having adjacent sides; interlocking means with complementary means on said adjacent side of said profiled strips; armored chain links; adjacent profiled strips being mounted pivotably relative to one another on said links; said profiled strips being of transparent plastics with all surfaces being completely polished, and having narrow sides with at least one projection; said links having opening means complementary to said projection; said projection being insertable and fastenable in said complementary opening means, said transparent plastics with all surfaces completely polished preventing undesired reflections and refractions of incident light for providing substantially uniform optically homogeneous viewing free of disturbances, said interlocking means with complementary means inhibiting formation of undesired light gaps

2. A shutter arrangement as defined in claim 1 wherein said profiled strips are comprised of acrylic glass.

3. A shutter arrangement as defined in claim 1 wherein said profiled strips are comprised of polycarbonate.

4. A shutter arrangement as defined in claim 1 wherein said projection of said profiled strips has a substantially trapezoidal shape.

5. A shutter arrangement as defined in claim 1 wherein said projection of said profiled strips has a substantially semi-circular shape.

6. A shutter arrangement as defined in claim 1 including a cross bolt for fastening said projection of said profiled strips in said opening means of said links.

7. A shutter arrangement as defined in claim 1 wherein said chain links are comprised of substantially light metal.

8. A shutter arrangement as defined in claim 1 including guide projection means located on both sides of at least part of said chain links, said chain links forming two chains, said guide projection means being located on both sides of at least part of said chain links in one of said two chains.

9. A shutter arrangement as defined in claim 8 wherein said guide projection means comprises a spacer pin projecting on both sides and being held in a cross bore of a chain link.

10. A shutter arrangement as defined in claim 8 wherein said guide projection means on chain links form an armored chain; and hook means on chain links of another armored chain.

11. A shutter arrangement as defined in claim 10 wherein said hook means form track roller means.

12. A shutter arrangement as defined in claim 11 wherein said track roller means has a carrier extending in a direction of said profiled strips, said carrier having one end fastened to an associated chain link and having a track roller on both sides of another end of said carrier.

13. A shutter arrangement as defined in claim 1 including cross bolt means for fastening said projection of said profiled strips in said opening means of said links, said chain links comprising substantially light metal, guide projection means located on both sides of at least part of said chain links, said chain links forming two chains, said guide projection means being located on both sides of at least part of said chain links in one of said two chains, said guide projection means comprising a spacer pin projecting on both sides and being held in a cross bore of a chain link, said guide projection means on said chain links forming an armored chain, hook means on chain links of another armored chain, said hook means forming track roller means having a carrier extending in a direction of said profiled strips, said carrier having one end fastened to an associated chain link having a track roller on both sides of another end of said carrier.

* * * * *